United States Patent [19]

Wendt

[11] Patent Number: 4,578,922

[45] Date of Patent: Apr. 1, 1986

[54] WIRE IMPALING CLIP FOR GYPSUM PANELS

[75] Inventor: Alan C. Wendt, Barrington, Ill.

[73] Assignee: United States Gypsum Company, Chicago, Ill.

[21] Appl. No.: 537,958

[22] Filed: Sep. 30, 1983

[51] Int. Cl.[4] ..... E04C 3/16

[52] U.S. Cl. ..... 52/774; 52/361; 52/358; 52/359; 52/775

[58] Field of Search ..... 52/361, 362, 363, 358, 52/359, 774, 765, 712, 715; 411/443, 444, 457, 485

[56] References Cited

U.S. PATENT DOCUMENTS

| | | | |
|---|---|---|---|
| 1,201,820 | 10/1916 | Hedden | 52/362 |
| 1,693,949 | 12/1928 | Grimm | 52/359 |
| 2,079,194 | 5/1937 | Williams | 52/363 |
| 2,307,899 | 1/1943 | Olsen | 52/357 |
| 2,319,129 | 5/1943 | Hamilton | 52/361 |
| 2,347,961 | 5/1944 | Olsen | 52/362 |
| 2,909,821 | 10/1959 | Olsen | 52/359 |
| 2,921,464 | 1/1960 | Olsen | 52/359 |
| 4,194,336 | 3/1980 | Weinar | 52/481 |

FOREIGN PATENT DOCUMENTS

| | | | |
|---|---|---|---|
| 594451 | 3/1960 | Canada | 52/362 |
| 530315 | 6/1955 | Italy | 411/443 |
| 710166 | 6/1954 | United Kingdom | 52/359 |

OTHER PUBLICATIONS

Cinch Wall Demountable Partitions Brochure, 4 pages, no date.

*Primary Examiner*—Henry E. Raduazo

*Attorney, Agent, or Firm*—Robert M. Didrick; Samuel Kurlandsky; Robert H. Robinson

[57] ABSTRACT

Gypsum panels and the like are attached to "H" studs by a resilient, one-piece wire clip having talons which are anchored in the edge of a panel and a clamping portion which grips a flange of the stud.

8 Claims, 10 Drawing Figures

WIRE IMPALING CLIP FOR GYPSUM PANELS

This invention relates to the progressive construction of movable partitions and ceilings in which wallboard panels are secured to a supporting framework comprised of metal studs, splines, runners and the like. In particular it relates to such construction without screws, bolts, nails or the like. The invention relates to the attachment of kerfed or non-kerfed gypsum panels, cement boards, fiber boards and the like to conventional "H" studs or "Z" splines with resilient, one-piece wire clips.

Numerous fasteners have been devised to secure such panels to framing members while avoiding the use of unsightly fastening devices. In U.S. Pat. No. 4,194,336 to Weinar, a barbed retainer clip engages a flange of an "H" stud by means of a resilient tab shear-formed from a flat plate of spring steel. "V"-shaped barbs extend from both surfaces of a leg of the clip which is perpendicular to the plate. When a panel is shoved into position against a retainer clip, the flat "V"-shaped barbs pierce the edge of the panel. A somewhat similar clip, sold under the trademark Cinch Wall, has such barbs formed at the edge of the perpendicular leg instead of in the surface and lie in a plane parallel to the stud-gripping plate. A disadvantage of such clips is the tendency for the flat barbs to cleave the gypsum core along the edges of the panel and thus weaken the panel at the points of attachment to the stud. Other disadvantages of such clips is that they displace a relatively large portion of the core and often bend while being driven into the edge of the panel, causing a visible bulge on the panel face. This phenomenon is commonly called "pooching".

It is therefore, an object of this invention to provide an improved wall construction.

It is a related object of this invention to provide a non-pooching resilient clip for attaching wallboard panels to metal framing members.

It is another related object of this invention to provide a concealable wallboard fastening clip which impales the edge of the wallboard without splitting the core material thereof.

It is yet another object of this invention to provide a clipfastened panel wall in which the anchored clips are resistant to disengagement by impact and vibration.

It is a further object of this invention to provide a system for packaging, handling, and affixing the resilient wire clips of this invention.

These and other objects of this invention will become apparent from the drawings and the description which follow.

In accordance with said objects, the fastening clip of this invention is a pronged clamp made from a continuous piece of music wire or the like. Each prong is a talon connected to a finger by a U-shaped knuckle so that the talons and fingers are substantially congruent. Each finger is connected to a return loop which may lie in the same plane as the fingers or in a plane perpendicular to such plane or partially in one plane and partially in the other. The return loops are connected by a bridging segment of the wire. The bridged return loops and the fingers cooperate to form a clamp. In use, the fingers are set flat on the back face of a panel so that the U-shaped arms overhang the margin of the panel and the talons are tapped or otherwise forced into the edge of the panel. When the required number of clips have thus been anchored in the panel, it is secured to an "H"-stud or the like in a partition by sliding the clamps onto the stud flange, thereby engaging the interior surface of the flange by the return loops.

Referring now to the drawings.

Figure 1:
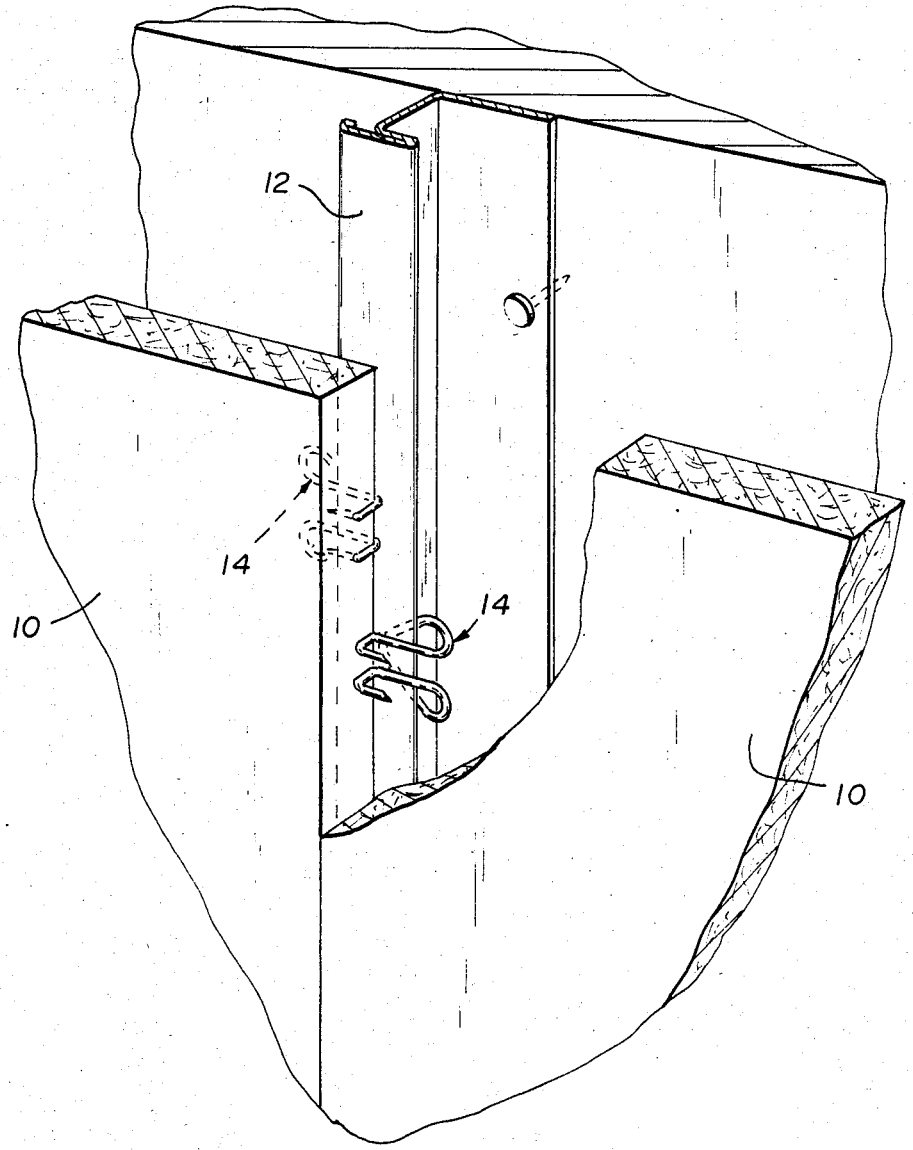
FIG. 1 is a perspective view, partially cut away, of a partition of this invention.
Figure 2:
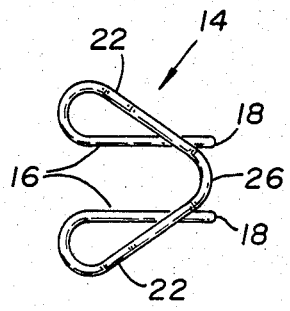
FIG. 2 is a top plan view of the clip shown in FIG. 1.
Figure 3:
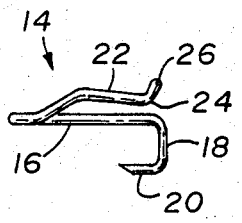
FIG. 3 is a side elevational view of the clip of FIGS. 1 and 2.

In FIG. 1, a panel 10 is secured to a framing member such as the Z-spline 12 by a plurality of the one-piece wire clips 14 which, as shown in FIGS. 2 and 3, comprse the fingers 16 which are bent into the U-shaped knuckles 18 and which terminate as the talons 20. The fingers 16 are bent at the other end into the return loops 22 which, at first, are co-planar with the fingers 16 but then diverge from and converge again with the fingers 16 at the nubs 24. A bridging segment of the wire is bent away from the fingers 16 to form the lip 26. To assure a tight seam between panels, the knuckles 18 may be sunk below the surface of the panel edges or the edges may be bevelled to accommodate the knuckles.

Figure 4:
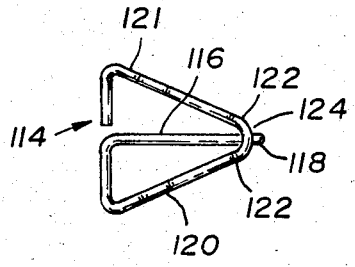
FIG. 4 is a top plan view of another embodiment of the clip of this invention.

The clip 114 of FIG. 4 has but one finger 116, one U-shaped knuckle 118 and one talon (not shown). Here, only the return loop 120 is connected directly to the finger; the return loop 121 terminates at the distal end of the wire from the talon. The nubs 122 are formed by the union of the return loops 120 and 121 with the lip 124.

Figure 5:
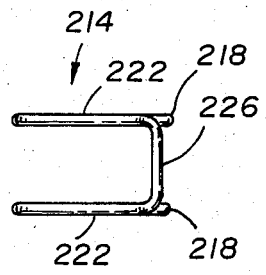
FIG. 5 is a top plan view of yet another embodiment of the clip of this invention.
Figure 6:
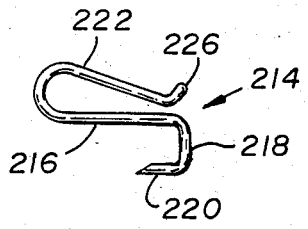
FIG. 6 is a side elevational view of the clip of FIG. 5.
Figure 7:
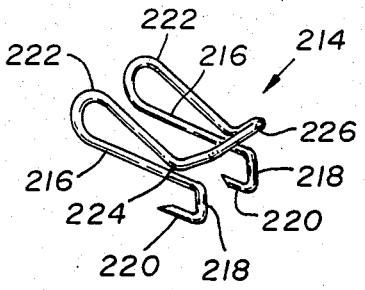
FIG. 7 is a perspective view of the clip of FIGS. 5 and 6.

In FIGS. 5, 6, and 7, the clip 214 has a rectangular aspect in that the fingers 216 and their respective return loops 222 lie in the same vertical planes. The return loops 222 do not have a segment that is horizontally co-planar with the fingers 216. The knuckles 218, talons 220, and the nubs 224 are like their counterparts in the clip 14, but the lip 226 is squared off in keeping with the rectangular aspect of the clip 214.

Figure 8:
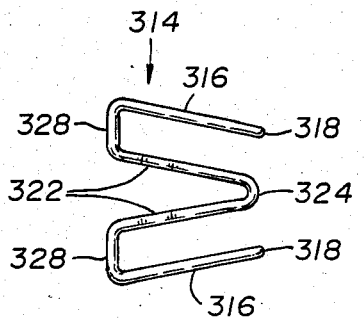
FIG. 8 is a top plan view of yet another embodiment of the clip of this invention.
Figure 9:
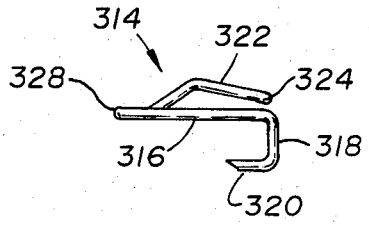
FIG. 9 is a side elevational view of the clip of FIG. 8.

In FIGS. 8 and 9, the fingers 316 and the return loops 322 form a W-shaped clip 314 in which the segment 328 of each loop is horizontally co-planar with its respective finger. The nub 324 is fixed by the furcation of the two return loops 322. The knuckles 318 and the talons 320 are like their counterparts in the clip 14.

Figure 10:
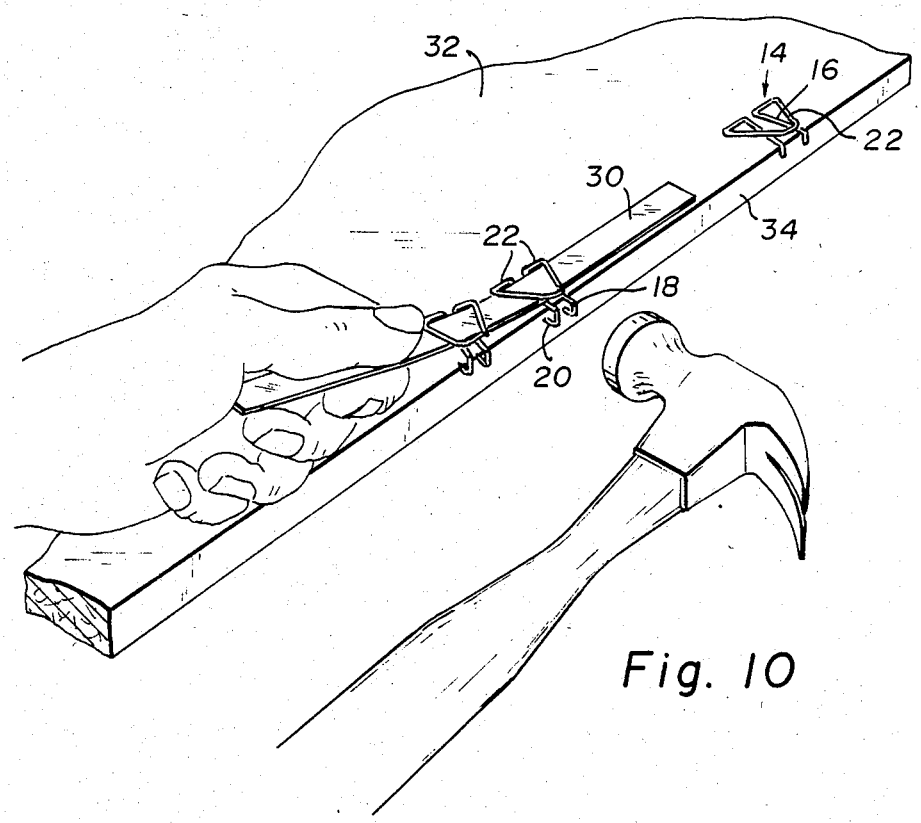
FIG. 10 is a perspective view of a system of this invention for the anchoring of clips in a gypsum board.

In FIG. 10, a plurality of clips 14 is carried on a steel tape 30 as the tape is laid on the back face of a vinyl laminated or fabric covered gypsum board 32 and aligned with the edge 34 of the board. The fingers 16 lie flat on the board and the talons 20 touch the edge 34 at about its midpoint. The clips 14 slide off of the tape 30 as they are anchored in the board by tapping the shoulder 18 with a hammer or the like.

Each individual clip may, of course, be held by hand as the talons are tapped into place but the tape 30 is a simple and convenient carrier for the clips during packaging, handling and anchoring operations. The tape needs to be only so wide that the nubs 24 may bear down resiliently against it. A plastic or a tough, stiff paper tape may be used instead of a steel tape.

The spacing of the clips of this invention along an edge of a building panel mnay be chosen according to particular requirements but 24 inch intervals are satisfactory for most installations. When the talons of each clip are spaced apart from one another, the space may be from about 0.3 to about 0.5 inch but it is preferably from about 0.35 to about 0.4 inch. The talons are about 0.2 inch long. The diameter of the wire used in fabricating the clip of this invention may be from about 0.04 to about 0.06 inch. The overall length of the clip is about 0.8 inch and the U-shaped knuckles project slightly (about 0.03 inch) beyond the bridging segment or lip so that the lip does not bump into the web of an "H" stud or the like and cause withdrawal of the talons from the panel core. The clips may be from about 0.4 to about 1 inch wide. The return loops converge to about 0.04 inch or less from the fingers and may even touch the fingers. When the bridging member is bent away from the fingers to form a lip, the angle is about 60° or less.

All dimensions given above may be converted to centimeters by multiplying by 2.54.

To compare the anchoring capabilities of the impaling wire clip of this invention with the triangular-barbed sheet metal clip of the prior art, a partition was built with gypsum boards secured to "H"-studs in a framework by the clips of this invention on one side and by the sheet metal clips on the opposite side of the partition. The gypsum boards were of the same kind and quality and were fastened by the same number of clips at the same intervals. The panels on either side of the partition were then, in turn, bumped rapidly and rhythmically to set up a resonant vibration. Upon inspection of the partition, many of the flat triangular barbs had broken out of the gypsum board and the board was held very loosely in the partition as a consequence of the damage. The talons of the wire clips of this invention, on the other hand, were still firmly anchored in the board and the stud was still firmly gripped by the clip. One reason for the superior capability of the wire clip of this invention is the fact that the compression of the gypsum core by the cylindrical talons as they push through the material is substantially uniform in all radial directions and is at a minimum in the axial direction whereas most of the compressive force of a flat triangular barb is vectored perpendicularly from the entry path of the barb. Another reason is that the relatively small cross section of the wire talons is less likely to encounter the slight irregularities in the composition of the core which are potential fracture lines.

While several particular embodiments of this invention have been described, it will be understood that the invention may be modified within the spirit and scope of the appended claims.

The subject matter claimed is:

1. A wall construction comprising a building panel having a front side, a back side, and opposing edges; a flanged framing member in which the flange has an exterior face and interior face; and a concealed clip which secures the panel to the framing member, said clip comprising a talon which is impaled in an edge of the panel and a clamp which grips a flange of the framing member; said talon and said clamp being formed from a continuous piece of wire having a first end and a second end by bending the wire to form, in sequence;

a talon at the first end of the wire, a U-shaped knuckle, a finger, a first return loop, a bridging segment, and second return loop; the finger and the return loops forming, in cooperation with the bridging segment, the clamp;

wherein the U-shaped knuckle bends around the corner of the panel between the impaled edge and the back side of said panel, and the finger lies flat against said back side and the exterior face of the flange.

2. A concealable anchor clip for securing a building panel having a front side, a back side and opposing edges to a flanged framing member, said clip comprising a pair of spaced-apart talons integral with the clamp, said talons and clamp being formed from a continuous piece of wire having a first end and a second end by bending said wire to form, in sequence:

a talon at the first end adapted to impale an edge of the panel, a first U-Shaped knuckle adapted to conform with one corner of the panel, a finger adapted to lie flat against the back side of the panel, a first return loop, a bridging segment, and a second return loop, a second finger adapted to lie flat against the back side of the panel, a second U-shaped knuckle adapted to conform with said corner of the panel, and a talon at the second end adapted to impale said edge of the panel, wherein each return loop diverges from the plane in which both fingers lie and then approaches said plane and the two sets of fingers and return loops co-operate with the bridging segment to form the clamp which is adapted to receive a flange of the framing member.

3. The clip of claim 2 wherein the bridging segment is bent at an acute angle relative to the plane in which both fingers lie.

4. The wall construction of claim 1 wherein the clip comprises a pair of spaced apart talons which are impaled in an edge of the panel and a clamp which grips a flange of the framing member; said talons and said clamp being formed from a continuous piece of wire having a first end and a second end by bending the wire to form, in sequence;

a talon at the first end of the wire, a first U-shaped knuckle, a first finger, a first return loop, a bridging segment, a second return loop, a second finger, a second U-shaped knuckle, and a talon at the second end of the wire; the two sets of fingers and return loops forming, in cooperation with the bridging segment, the clamp;

wherein the U-shaped knuckles bend around the corner of the panel between the impaled edge and the back side of said panel, and the fingers lie flat against said back side and the exterior face of the flange.

5. The wall construction of claim 1 wherein a segment of each return loop lies flat against the back side of the panel.

6. The wall construction of claim 1 wherein each return loop diverges from the back side of the panel and then approaches said back side.

7. The wall construction of claim 4 wherein the bridging segment is bent at an acute angle relative the plane in which both fingers lie.

8. A system for facilitating the affixation of the clip of claim 2 to a building panel which comprises a tape of indefinite length and a plurality of said clips mounted on the tape in an array adapted for alignment of the talons of said clips with an edge of the panel.

* * * * *